US011370513B2

(12) United States Patent
Heikkinen et al.

(10) Patent No.: US 11,370,513 B2
(45) Date of Patent: Jun. 28, 2022

(54) METHOD OF MONITORING DIVING AND A SYSTEM FOR MONITORING OR PLANNING A DIVE

(71) Applicant: Suunto Oy, Vantaa (FI)

(72) Inventors: Aimo Heikkinen, Vantaa (FI); Toni Leskelä, Vantaa (FI)

(73) Assignee: Suunto Oy, Vantaa (FI)

( * ) Notice: Subject to any disclaimer, the term of this patent is extended or adjusted under 35 U.S.C. 154(b) by 402 days.

(21) Appl. No.: 13/803,795

(22) Filed: Mar. 14, 2013

(65) Prior Publication Data

US 2014/0100788 A1 Apr. 10, 2014

Related U.S. Application Data

(60) Provisional application No. 61/712,007, filed on Oct. 10, 2012.

(30) Foreign Application Priority Data

Oct. 8, 2012 (FI) ..... 20126050

(51) Int. Cl.
*B63C 11/02* (2006.01)

(52) U.S. Cl.
CPC ..... *B63C 11/02* (2013.01); *B63C 2011/021* (2013.01)

(58) Field of Classification Search
CPC ..... B63C 11/02; B63C 2011/021
See application file for complete search history.

(56) References Cited

U.S. PATENT DOCUMENTS 4,658,358 A * 4/1987 Leach ..... B63C 11/32 128/201.27
5,363,298 A * 11/1994 Survanshi et al. ..... 73/865.1
5,794,616 A 8/1998 Cochran et al.
5,845,235 A 12/1998 Luukkanen et al.
(Continued)

FOREIGN PATENT DOCUMENTS

EP 2233392 A 9/2010

OTHER PUBLICATIONS

Unknown Author, Isobaric counterdiffusion, Wikipedia, Aug. 16, 2012.*

(Continued)

*Primary Examiner* — Kyle R Quigley
(74) *Attorney, Agent, or Firm* — Laine IP Oy

(57) ABSTRACT

The invention concerns a method, device and computer program product for monitoring or planning a dive of a diver. The method includes providing data on the composition of gases breathed by the diver during the dive, providing data on the depth or ambient pressure of the diver, and using a model to provide a safe ascent profile for the diver based on the data on the composition of gases and on the depth or ambient pressure. According to the invention, the method further comprising detecting, based on the data on the composition of gases, a gas composition change which may lead to a deep tissue isobaric counter diffusion situation, and the model comprising means for immediately temporally retarding the ascent profile if such gas composition change is detected. The invention can be used to mitigate the harmful effects of dangerous breathing gas changes during diving.

18 Claims, 3 Drawing Sheets

(56) References Cited

U.S. PATENT DOCUMENTS

| | | | |
|---|---|---|---|
| 5,850,626 | A | 12/1998 | Kallio |
| 6,029,515 | A | 2/2000 | Lahteenmaki et al. |
| 8,024,023 | B2 | 9/2011 | Tolvanen |
| 8,275,311 | B2 | 9/2012 | Lindman |
| 8,660,826 | B2 | 2/2014 | Leskela et al. |
| 9,055,879 | B2 | 6/2015 | Selby et al. |
| 9,225,435 | B2 | 12/2015 | Rahkonen et al. |
| 2003/0056786 | A1 | 3/2003 | Hollis |
| 2007/0213964 | A1 | 9/2007 | Goldman |
| 2010/0250208 | A1* | 9/2010 | Leskela et al. ..... 703/2 |
| 2011/0102177 | A1* | 5/2011 | Johnson ..... H04B 11/00 340/540 |
| 2013/0311123 | A1 | 11/2013 | Nieminen et al. |
| 2013/0339409 | A1 | 12/2013 | Kallio et al. |
| 2014/0277628 | A1 | 9/2014 | Nieminen et al. |
| 2015/0071280 | A1 | 5/2015 | Ahola et al. |
| 2015/0182795 | A1 | 7/2015 | Martikka et al. |
| 2015/0182841 | A1 | 7/2015 | Martikka et al. |
| 2015/0182842 | A1 | 7/2015 | Martikka et al. |

OTHER PUBLICATIONS

Doolette et al., Biophysical basis for inner ear decompression sickness, J Appl Physiol 94, 2003 (Year: 2003).*

Burton S/ scubaengineer.com: Isobaric Counter Diffusion. Dec. 2004 (Rev: 2011).

Doolette et al: Biophysical basis for inner ear decompression sickness. Journal of Applied Physiology. 2003, Bd. 94, H. 6, S. 2145-2150.

Ellyatt m: Deep explorer: 2007 (Technical Series). 68 S.

* cited by examiner

METHOD OF MONITORING DIVING AND A SYSTEM FOR MONITORING OR PLANNING A DIVE

RELATED APPLICATIONS

The present application claims priority to U.S. Provisional Patent Application Ser. No. 61/712,007 titled A METHOD OF MONITORING DIVING, A DIVING COMPUTER AND A COMPUTER PROGRAM PRODUCT FOR MONITORING OR PLANNING A DIVE, and filed on Oct. 10, 2012. The present application claims priority to Finnish Patent Application No. 20126050, and filed on Oct. 8, 2012.

FIELD OF THE INVENTION

The invention relates to diving aids. In particular, the invention relates to a method of monitoring diving, a diving computer and a system for monitoring or planning a dive. The invention is intended to be used in particular in technical diving, in which compressed gases and a diving computer are used.

BACKGROUND OF THE INVENTION

In scuba diving, it is typical to use a diving suit, compressed-gas tanks, a breathing regulator, and a diving computer. The diving computer shows the diver information on the prevailing environment, such as depth, pressure, diving time, and gases available, and on the basis of this information, calculates the parameters that are important to performance. A decompression model is typically programmed into the device. The most important parameters tracked and/or calculated by the diving computer are the temporal sufficiency of the available gases and the safe ascent time in decompression diving.

When diving to a sufficient depth, or if diving lasts for a sufficient length of time, the diver's surfacing speed must be limited. In deep diving, amounts of nitrogen, helium, and other inert gases, which depend on the partial pressure of the gas inhaled, collect in the diver's blood circulation and tissues. This process is driven by the pressure gradients of the gases, and in particular, between the gas inhaled and the tissues of the diver. The rate of collection and release of gases is tissue-specific and vary considerably. The accumulated nitrogen can causes problems when the diver rises towards the surface, and the ambient pressure decreases. Nitrogen and other gases can be released from the tissues of the diver leading to an increased risk of decompression sickness (DSC). The partial pressure of precisely nitrogen and helium is therefore monitored carefully when diving. DCS is a state in which nitrogen that has expanded in the blood or tissue due to a reduction in pressure forms bubbles, which, when they expand, can block blood vessels and damage tissue. To reduce the risk, the diver must observe a safe ascent profile. The diving computer typically provides a safe ascent profile for the diver by determining the depth for performing a safety stop or stops, and the amount of decompression time required at each safety stop. This calculation or determination is performed on the basis of the diving profile and decompression model, as well as of the prevailing conditions.

Commercial diving computers are previously known, and typically calculate a suitable decompression time based on the programmed gases using suitable decompression models. For example, VR Technology Ltd.'s VR3 diving computer prepares a dive plan based on the programmed gases, in such a way that the device calculates the time required for ascent by adapting the available gases to the prevailing conditions. Another example includes, the Suunto® HelO2™ diving computer enables the diver to program the available diving gases, prior to diving. During diving, the device's calculation algorithm suggests safety stops to avoid DCS. European Patent No. EP2233392 discloses a method which helps the diver to react better in problem situations during diving where the diver must alter the gas mixture while subject to the stress arising from a decompression problem. There are also numerous other diving aids on the market e.g. from GAP-Software, HHS Software Corp. and Liquivision.

A specific problem can arise in a situation where during ascent from deep, the diver performs a wrong gas exchange leading to a rapid increase in nitrogen partial pressure, while the amount of helium is still high in tissues of the diver. This problem can lead to a so-called deep tissue isobaric counter diffusion (ICD), in which both the outward diffusion of helium and inward diffusion of nitrogen are at high level. This condition typically leads to bubbling of gases in the tissue and ultimately to tissue damage.

None of the above methods or diving aids are configured to address the ICD situation during planning or monitoring of diving in a highly effective manner. Some of the present models have even been found to improperly advise the diver to ascend faster in an ICD situation, which can be very dangerous for the diver.

Thus, there is a need for improved methods for monitoring diving, diving computers and computer program products for monitoring or planning a dive.

SUMMARY OF THE INVENTION

It is an aim of the invention to provide a solution to the abovementioned ICD problem. The present invention is based on the idea of detecting the potentially harmful ICD situation based on a change in breathing gas composition. When a particular change in breathing gas composition is identified, the present invention provides for a method, a diving computer and a system for making an immediate correction to the ascent profile suggested to the diver. The immediate correction comprises temporally retarding the previously calculated ascent profile. Preferably, the correction comprises a full ascent "penalty", i.e., a decompression stop, making the ascent profile flat for a predefined period. Alternatively or preferably in addition to that, the correction comprises a slowed down ascent period for a certain duration or for the rest of the dive.

According to one embodiment, the present method of monitoring or planning a dive of a diver includes:

providing data on the composition of gases breathed by the diver during the dive;

providing data on the depth or ambient pressure of the diver;

using a model to provide a safe ascent profile for the diver based on the data on the composition of gases and on the depth or ambient pressure;

detecting, based on the data on the composition of gases, a gas composition change which may lead to a deep tissue isobaric counter diffusion situation, wherein the model includes a mechanism for immediately temporally retarding the ascent profile if such gas composition change is detected.

According to one embodiment, the diving computer for monitoring a dive of a diver includes:

a mechanism for providing data on the composition of gases breathed by the diver during the dive;

a mechanism for providing data on the depth or ambient pressure of the diver;

a processor comprising a programmed model adapted to provide a safe ascent profile for the diver based on the data on the composition of gases and the depth or ambient pressure;

a display configured to include information on the safe ascent profile to the diver; and the processor being configured to detect, based on the data on the composition of gases, a gas composition change which may lead to a deep tissue isobaric counter diffusion situation.

ICD situations have not previously been detected in monitoring applications during actual dives using a diving computer as characterized above. In a further preferred embodiment, if a gas composition change which leads to an ICD situation is detected, the processor is adapted to immediately form a temporally retarded ascent profile.

The invention also provides a system for planning or monitoring a dive of a diver, comprising:

a processor configured to store data on the composition of gases breathed by the diver at each moment during the dive;

the processor further configured to provide data on the depth or ambient pressure of the diver at each moment of time during the dive, the processor further configured to provide a safe temporal ascent profile for the diver based on the data on the composition of gases breathed and the depth or ambient pressure, a memory and a display configured to store and display, respectively, the safe ascent profile to the diver, a detection algorithm adapted to detect, based on the data on the composition of gases, a gas composition change which may lead to a deep tissue isobaric counter diffusion situation, and a correction algorithm adapted to immediately form a temporally retarded ascent profile if such gas composition change is detected.

The system be stored and run or included in a desktop or laptop computer or a wearable diving computer.

Considerable advantages are obtained by the present invention. The invention prevents the potentially dangerous situation where a diver makes a dangerous gas change but fails to recognize the dangerous gas change, or improperly takes the gas change into account and reacts to it in an incorrect manner. Although the fundamental error has already happened when the dangerous gas change takes place, the consequences can be significantly relieved by making immediate corrective actions, i.e. sanctioning an ICD penalty for the diver by amending the ascent profile towards a slower ascent. In the present invention, the gas pressures in tissues are not allowed to decrease too fast, thus discouraging gas changes that increase the risk of cross diffusion and bubbling.

Definition of Terms

The term "deep tissue isobaric counter diffusion (ICD) situation" refers to a situation where there is bidirectional breathing gas diffusion in any tissue at a rate that may potentially cause tissue damage. In particular, the term refers to a situation where the breathing gas initially comprises helium which has accumulated in a tissue and a gas change to nitrogen is made before the helium level in tissue has decreased to at least a predefined level.

"Ascent profile" refers to a highest temporal ascent rate recommended to the user by the method, device, computer program product, or a system. The recommended ascent rate is not generally constant over time but has sections of different slopes depending on the diving history, depth and/or gases used.

"ICD penalty" refers to retarding the ascent profile through a complete temporary ascending stop and/or by decreasing the slope of the ascending profile after the ICD situation is detected.

"Monitoring a dive" refers to a situation where the diver is under water and real-time pressure information is available. The safe ascent profile can be formed based on real measurement data.

"Planning a dive" refers to a situation where a dive is planned before the actual dive for example on a computer. The safe ascent profile can be formed based on assumed diving data.

This invention will become more fully understood from the following detailed description, taken in conjunction with the accompanying drawings described herein below, and wherein like reference numerals refer to like parts.

DETAILED DESCRIPTION OF EMBODIMENTS

Figure 1:
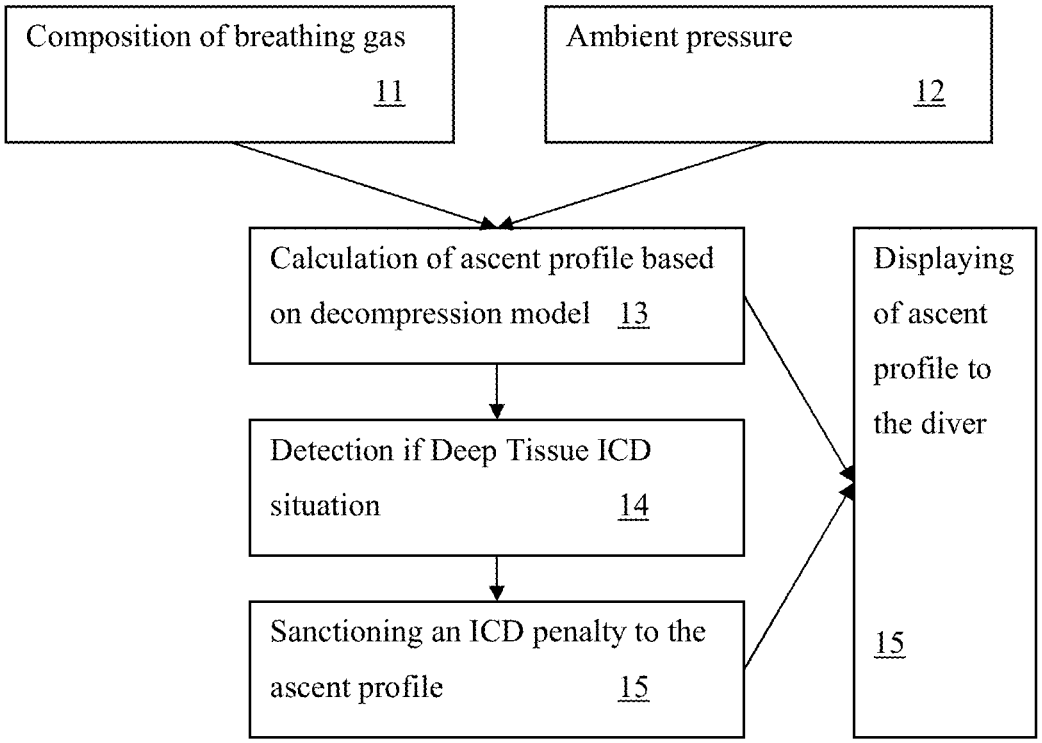
FIG. 1 illustrates as a flow chart the method according to a preferred embodiment of the present invention.

With reference to FIG. 1 according to a preferred embodiment, the present method includes in step 11 measuring (during diving) or retrieving programmed data on (during planning) the composition, i.e., partial pressures of components, of the breathing gas at each moment. In addition, ambient pressure is typically measured or estimated at each moment in step 12. This data is used to calculate a safe ascent profile in step 13 according to a pre-programmed decompression model.

As the ICD situation may only occur when changing gas composition, the changes are monitored. When a change is detected in step 14 through measurement of partial pressures of the gases or by other means in step 14, an ICD penalty is sanctioned for the diver in step 15.

Figure 2:
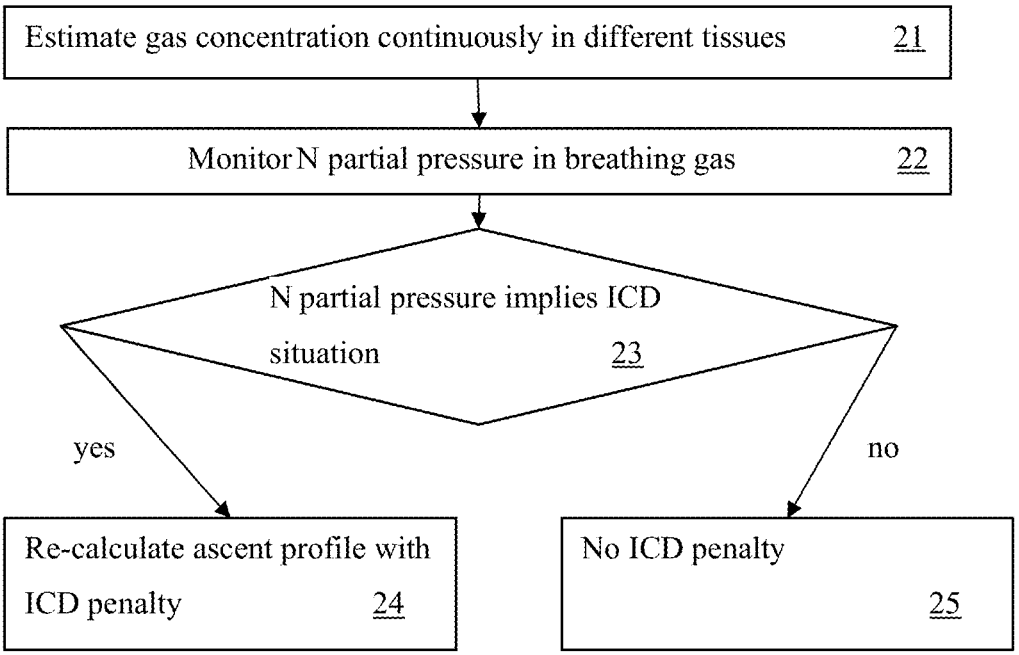
FIG. 2 illustrates in more detail portion of the method according to another preferred embodiment of the present invention.

With reference to FIG. 2, the Deep Tissue ICD situation detection and ICD penalty decision-making can be carried out in the following way. First, the gas concentration is continuously estimated in different tissues using a suitable decompression model (step 21). Such models are known in the art and the present invention is not limited to any particular decompression model. Preferably, the decompression model utilizes at least 5, typically at least 9 tissue groups having different gas diffusion characteristics to provide sufficient reliability of estimation. At the same time, and in particular during the ascending phase of the dive, the method comprises monitoring changes in nitrogen partial pressure in the breathing gas (step 22). If the change in the partial pressure exceeds predefined criteria, i.e. is high or fast enough (step 23), there is a potential ICD situation and the ascent profile is recalculated (step 24) to comprise an ICD penalty to avoid or mitigate harmful ICD effects in that tissue(s). If no alarming change in the nitrogen partial pressure is detected, the diver may be advised to continue ascending using a previously calculated ascent profile or continuous profile calculation method which is not changed (step 25) without an ICD penalty.

According to one embodiment, the ICD penalty is determined in the following way:

1. The partial pressure of nitrogen is monitored. If the change of the partial pressure rises above a predefined threshold (e.g. 0.5 bar), an ascending stop having a length is sanctioned.
2. The partial pressure of helium is monitored. If a drop the partial pressure of helium is detected and criterion 1 above is fulfilled, the length of the ascending stop is prolonged.
3. If the summed-up change of nitrogen and helium partial pressures exceeds predefined criteria (e.g. total change greater than 0.75 bar), an additional slowed-down ascending profile is sanctioned for the diver.

According to one embodiment, the strength of the ICD penalty is affected by the depth at which the ICD situation occurs. Thus, the ICD penalty determination function or algorithm has the current depth (or ambient pressure) as a parameter. Typically, the ICD penalty is heavier at larger depths than at smaller depths because also the risk for potential physiological harmful effects is proportional to the depth.

The ICD penalty determination described above is given by way of example only and it may be varied to provide an alternatively determined different levels of penalty, depending on the seriousness of the wrong gas change observed based on observing the partial pressures of one or more of the breathing gases during the ascending phase of the dive.

Figure 3A:
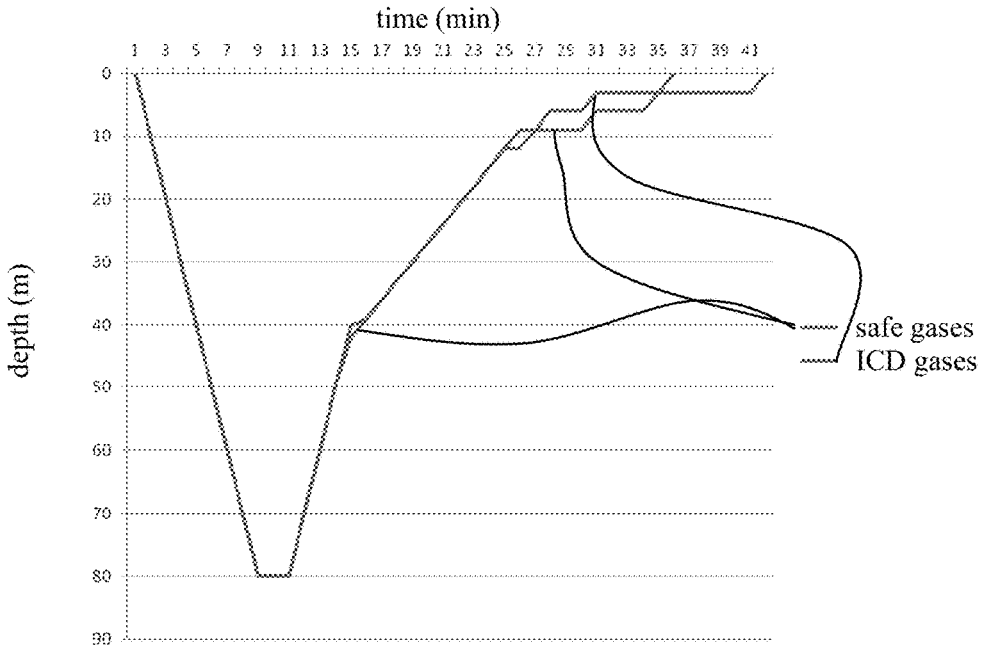
Fig. 3a (prior art)
FIG. 3*a* illustrates graphical representations of ascent profiles (depth vs. time) with safe (non-ICD causing) gases and ICD-causing gases calculated using a conventional method.

FIG. 3*a* shows two exemplary ascent profiles calculated using a prior art calculation method. In a first ascent profile 50 of a dive, the ascent profile 50 is made using safe gases, i.e. no dangerous gas exchanges have been made. In a second ascent profile 52, the second ascent profile 52 represents a situation, where a dangerous (ICD-causing) gas change is made at a depth of 40 m. The profile calculation algorithm is the same in both cases. As can be seen, the gas exchange does not cause any retarding of the ascent profile but in fact causes a small immediate rise in the proposed ascent rate. Also the proposed surfacing takes place sooner in the ICD situation than in the safe situation, which can be detrimental for the health of the diver.

Figure 3B:
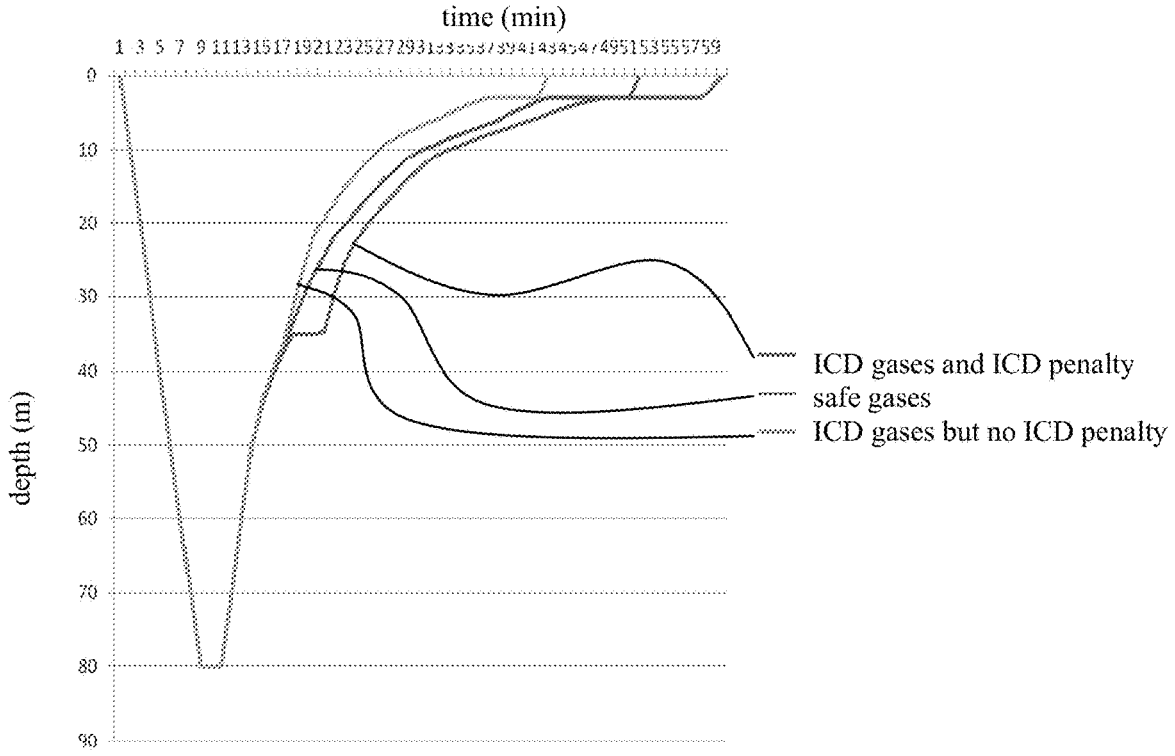
FIG. 3*b* illustrates graphical representations of three separate ascent profiles (depth vs. time).

FIG. 3*b* illustrates a similar case with a different calculation method. The middle curve 62 shows an ascent profile made with safe gases. The topmost curve 64 shows as an ascent profile with a dangerous gas change being made at a depth of about 35 m. As can be seen, this method is even more sensitive to the gas change, but again in the wrong direction. The proposed ascending rate of the topmost curve 64 is actually considerably accelerated by the wrong gas change, which is typical to most existing calculation methods.

The undermost curve 60 of FIG. 3*b* is according to a preferred embodiment of the present invention. In this example, the temporally retarded ascent profile comprises a period of no ascending immediately after the detection of the ICD situation. This period causes the potential harmful effects of the dangerous gas change to be as small as possible. After the ICD penalty, the ascending continues. Now that the ICD effects have been minimized, ascending may continue according to the original model (at the slope of the topmost curve) or at a further slowed-down rate. Due to the penalty and potential further retarding, also the surfacing takes place later than in the two other cases.

The ascending stop preferably has a duration of at least one minute, preferably at least two minutes, and more preferably within the range of 1 to 5 minutes. This ensures that the gas cross diffusion in the tissue has reached a safe level and ascending may continue.

According to one embodiment, the temporally retarded ascent profile comprises, in addition to a full temporary ascending stop, a second period of slowed down ascending. Slowed down ascending means that the ascending speed, i.e. slope of the ascending profile, is smaller compared with the ascending speed given by the model without the detection of the ICD situation.

According to one embodiment, the detection of the ICD situation is carried out by detecting an abrupt rise in nitrogen partial pressure when the breathing gas initially contains helium.

The decompression model typically comprises different gas diffusion parameters for a plurality of different tissue groups. Tissue groups have been formed based on their tendency to allow gas diffusion in/out of the tissue from/to blood circulation, i.e. their gas diffusion parameters. The model also takes into account takes into account gas breathing history and depth or ambient pressure history to estimate the current concentration of gases in the different tissues. The model may also take into account other factors, such as ventilation. The model is run continuously. The safe ascending profile is determined so that in all tissue groups the gas levels and therefore also the gas diffusion rates remain at a predefined safe rate. In an ICD situation caused by the diver's wrong gas change, such safe levels and rates cannot be guaranteed. Undesired consequences and risks can, however, be minimized using the present invention.

According to one embodiment of the invention, the method is carried out during diving in a diving computer for real-time monitoring a dive and real-time guiding of the diver for safe ascending.

Figure 4:
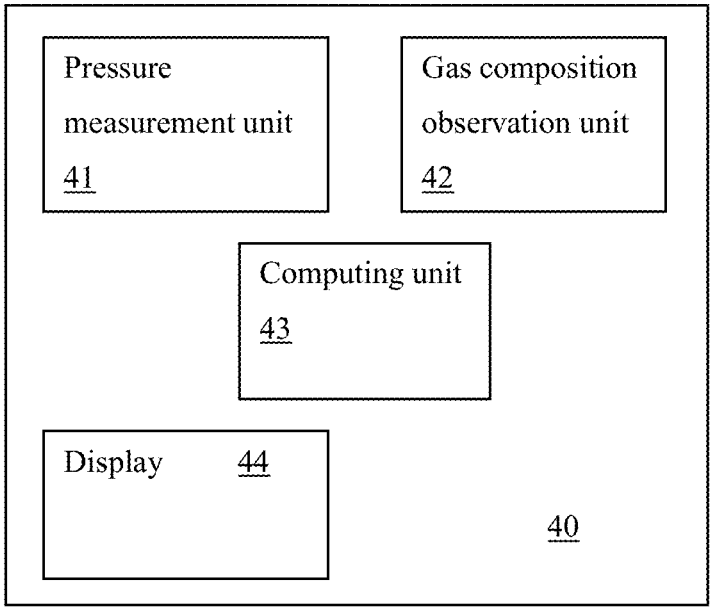
FIG. 4 is a block diagram a diving computer according to another preferred embodiment of the present invention.

FIG. 4 illustrates as a block diagram a diving computer 40 according to one embodiment of the invention. The diving computer 40 comprises a computing unit or processor 43 which is in functional connection with a pressure measurement unit 41 and gas composition observation unit 42. The computing unit runs the decompression model and the ICD detection algorithm discussed above. In addition, there is a display for displaying or communicating information on the ascent profile for the diver and there may be also alerting means for indicating the diver of a detected ICD situation and ICD penalty sanctioned.

In an alternative embodiment the method is carried out in a desktop, laptop or handheld computer, such as a mobile phone or tablet computer, for planning a dive. In such a computer, the pressure measurement unit and gas composition observation unit are replaced with computer-readable data on the pressure and gas composition during the dive planned.

While the preferred embodiments of the invention have been illustrated and described, it will be appreciated that various changes can be made therein without departing from the spirit and scope of the invention. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A method of monitoring or planning a dive of a diver, comprising:

providing data on a composition of breathing gases containing helium using a gas composition observation unit;

providing data on the diving depth or the ambient pressure of the diver, using a pressure measurement unit;

providing an original safe ascent profile for the diver based on the data on the composition of breathing gases and on the depth or ambient pressure;

estimating a helium concentration in a tissue of the diver based on the data on the composition of breathing gases and on the depth or ambient pressure;

monitoring the composition of gases for an abrupt rise in nitrogen partial pressure of said breathing gases which may lead to a deep tissue isobaric counter diffusion (ICD) situation; and in response to a detected abrupt rise in the nitrogen partial pressure of said breathing gases when the estimated helium concentration in the tissue of the diver is above a predefined level, providing a temporal ascent profile comprising an immediate temporal retardation of said original safe ascent profile.

2. The method according to claim 1, wherein the temporally retarded ascent profile comprises a first period of no ascending immediately following the detection of the abrupt rise in nitrogen partial pressure of the breathing gas when the breathing gas initially contains helium.

3. The method according to claim 2, wherein the first period has a duration of at least one minute.

4. The method according to claim 2, wherein the first period has a duration within the range of 1 to 5 minutes.

5. The method according to claim 2, wherein the temporally retarded ascent profile comprises a second period of slowed down ascent that ends at a time later than a corresponding period of the original ascent profile.

6. The method according to claim 1, wherein the method further comprises determining different gas diffusion parameters for a plurality of different tissue groups, and taking into account gas breathing, depth or ambient pressure history, and gas diffusion parameters to estimate the current concentration of gases in the different tissues.

7. The method according to claim 1, wherein the temporal retarding of the original ascent profile depends on the depth or ambient pressure at the time of the gas composition change.

8. The method according to claim 7, wherein the temporally retarded ascent profile is retarded more at high depths or ambient pressures than at lower depths or ambient pressures.

9. The method according to claim 1, wherein the temporal retarding of the original ascent profile is carried out in real time.

10. The method according to claim 1, wherein the method is carried out during diving in a diving computer for monitoring the dive.

11. The method according to claim 1, wherein the method is carried out in a desktop, laptop or handheld computer for planning the dive.

12. The method according to claim 1, wherein the providing the temporally retarded ascent profile comprises displaying said profile on the display of a dive computer.

13. A diving computer for monitoring a dive of a diver, comprising:

a pressure sensing unit;

a gas composition observation unit to sense gas composition and output data on the composition of gases breathed by the diver during the dive;

a processor operably coupled to the pressure sensing unit and to the gas composition observation unit, the processor configured to receive the data on the composition of gases breathed by the diver during the dive from the gas composition unit, the processor configured to receive data on the depth or ambient pressure of the diver from the pressure sensing unit;

an algorithm associated with the processor including a programmed model adapted to provide a safe ascent profile for the diver based on the data on the composition of gases and the depth or ambient pressure;

a display configured to provide information on the safe ascent profile to the diver, wherein, the processor is adapted to:

estimate a helium concentration in a tissue of the diver based on the data on the composition of breathing gases and on the depth or ambient pressure;

detect a deep tissue isobaric counter diffusion (ICD) situation, based on the data on the composition of gases indicating an abrupt rise in nitrogen partial pressure of the breathing gas before the estimation of a helium concentration in the tissue of the diver has decreased to a predefined level, and wherein the processor is configured to immediately form and present on the display a temporally retarded ascent profile in response to the detected ICD situation.

14. The diving computer according to claim 13, wherein the temporally retarded ascent profile comprises a first period of no ascending, and wherein the first period has a duration of at least one minute.

15. The diving computer according to claim 13, wherein the temporally retarded ascent profile comprises a first period of no ascending, and wherein the first period is within the range of 1 to 5 minutes.

16. The diving computer according to claim 14, wherein the temporally retarded ascent profile comprises a second period of slowed down ascending compared with the ascending speed given by the model without the detection of the gas composition change.

17. The diving computer according to claim 13, being adapted to retard the ascent profile depending on the depth or ambient pressure at the time of detection of the gas composition change.

18. A method of monitoring or planning a dive of a diver, comprising:

providing data on the composition of gases breathed by the diver during the dive using a gas composition observation unit;

providing data on the depth or ambient pressure of the diver using a pressure measurement unit;

outputting an original ascent profile to the diver to provide a safe ascent profile for the diver based on the data on the composition of gases and on the depth or ambient pressure;

estimating a helium concentration in a tissue of the diver based on the data on the composition of breathing gases and on the depth or ambient pressure;

detecting, prior to the estimated helium concentration in the tissue of the diver decreasing to a predefined level, based on the data on the composition of gases, an abrupt rise in nitrogen partial pressure of the breathing gas and a drop in the partial pressure of helium, when the breathing gas initially contains helium which may lead to a deep tissue isobaric counter diffusion (ICD) situation; and computing a temporally retarded ascent profile based on the partial pressures, predefined criteria and the current depth;

outputting a temporally retarded ascent profile in response to the detected abrupt rise in nitrogen partial pressure of the breathing gas when the breathing gas initially contains helium, the temporally retarded ascent profile comprising an immediate temporal retardation of the original ascent profile.

* * * * *